US009062864B2

(12) United States Patent
Guercio et al.

(10) Patent No.: US 9,062,864 B2
(45) Date of Patent: Jun. 23, 2015

(54) LIGHT FIXTURE WITH SELECTABLE EMITTER AND REFLECTOR CONFIGURATION

(71) Applicant: RAB Lighting Inc., Northvale, NJ (US)

(72) Inventors: Vincenzo Guercio, Wallkill, NY (US); Jiang Hu, Ningbo (CN); Dan Wang-Munson, Bergenfield, NJ (US)

(73) Assignee: RAB Lighting Inc., Northvale, NJ (US)

( * ) Notice: Subject to any disclaimer, the term of this patent is extended or adjusted under 35 U.S.C. 154(b) by 78 days.

(21) Appl. No.: 13/908,204

(22) Filed: Jun. 3, 2013

(65) Prior Publication Data

US 2013/0322074 A1 Dec. 5, 2013

Related U.S. Application Data

(60) Provisional application No. 61/654,768, filed on Jun. 1, 2012.

(51) Int. Cl.

| | |
|---|---|
| ***F21V 29/00*** | (2006.01) |
| ***F21V 7/00*** | (2006.01) |
| ***F21S 8/02*** | (2006.01) |
| *F21Y 101/02* | (2006.01) |
| *F21Y 103/02* | (2006.01) |

(52) U.S. Cl.

CPC ..... *F21V 29/002* (2013.01); *F21V 7/00* (2013.01); *F21V 29/004* (2013.01); *F21S 8/02* (2013.01); *F21V 7/0008* (2013.01); *F21Y 2101/02* (2013.01); *F21Y 2103/02* (2013.01)

(58) Field of Classification Search

CPC ..... F21V 29/00; F21V 29/02; F21V 29/004; F21V 7/00; F21V 29/002; F21V 29/20; F21V 29/22; F21V 29/2206; F21V 29/2212; F21V 29/2268

See application file for complete search history.

(56) References Cited

U.S. PATENT DOCUMENTS

| | | | | |
|---|---|---|---|---|
| 6,367,949 | B1 | 4/2002 | Pederson | |
| 7,445,362 | B2 * | 11/2008 | Compton et al. | 362/346 |
| 7,484,875 | B2 | 2/2009 | Kim et al. | |
| 7,611,264 | B1 * | 11/2009 | Chang et al. | 362/249.02 |
| 7,674,009 | B2 | 3/2010 | Chang | |
| 7,810,951 | B1 | 10/2010 | Lee et al. | |
| 7,841,734 | B2 | 11/2010 | Wilcox | |
| 7,972,036 | B1 | 7/2011 | Schach et al. | |
| 8,007,135 | B2 * | 8/2011 | Xiang et al. | 362/294 |
| 8,192,049 | B2 * | 6/2012 | Hyun et al. | 362/241 |
| 2007/0206384 | A1 * | 9/2007 | Compton et al. | 362/326 |

(Continued)

OTHER PUBLICATIONS

Yimin Gu and Nadarajah Narendran, Design and evaluation of an LED-based light fixture. Third International Conference on Solid State Lighting, Proceedings of SPIE, 2004, 318-329, Lighting Research Center, Rensselaer Polytechnic Institute, Troy NY.

*Primary Examiner* — Bao Q Truong

(74) *Attorney, Agent, or Firm* — SmithAmundsen LLC; Kelly J. Smith; Dennis S. Schell

(57) ABSTRACT

An illustrative lighting fixture provides a light housing, a thermally conductive inwardly facing annular surface, one of a selection of light reflectors, and an associated lens cover. Mounting pads defined by the annual surface and the light reflector together receiving a selected number of light emitters and associated heatsinks coupled to selected ones of the mounting pads. Each of the selection of light reflectors includes openings for the light emitters and reflective surfaces matching a number and combination of positions of light emitters on selected ones of the mounting pads.

18 Claims, 4 Drawing Sheets

(56) References Cited

U.S. PATENT DOCUMENTS

| | | | | |
|---|---|---|---|---|
| 2008/0080188 | A1 | 4/2008 | Wang | |
| 2009/0103294 | A1* | 4/2009 | Zhang et al. | 362/234 |
| 2009/0267519 | A1 | 10/2009 | Pearse | |
| 2009/0268453 | A1 | 10/2009 | Pearse | |
| 2010/0091507 | A1* | 4/2010 | Li et al. | 362/470 |
| 2010/0208460 | A1 | 8/2010 | Ladewig et al. | |
| 2011/0019409 | A1 | 1/2011 | Wronski | |

* cited by examiner

LIGHT FIXTURE WITH SELECTABLE EMITTER AND REFLECTOR CONFIGURATION

CROSS-REFERENCE TO RELATED APPLICATIONS

This application is a nonprovisional of U.S. Provisional patent application No. 61/654,768, filed Jun. 1, 2012, and titled Light Fixture with Selectable Emitter and Reflector Configuration, which is herein entirely incorporated by reference.

BACKGROUND

The present invention relates to light distribution and light emitter cooling features for light fixtures, and particularly, to providing a light fixture with selectable locations, orientations, and quantity of light emitters.

A single light housing design can be used to provide a number of light fixtures providing different lighting features by changing various features of the fixture other than the housing. For example, in incandescent and fluorescent light fixtures, variations in fixtures with the same housing are sometimes provided by using a variety of bulb wattages or quantities, or by including an adjustable reflector and/or shade that varies the light distribution pattern.

Managing the temperature of light sources in a light fixture is generally important to performance and longevity. This is particularly true with newer highly efficient lighting technology, for example, light sources such as LEDs, laser diodes, or other light emitters. LEDs are generally selected to maximize the light output for a given power consumption at a reasonable cost. Because LED light sources operate at a much lower temperature than typical incandescent light sources, less energy is wasted in the form of heat production. However, LEDs tend to be more sensitive to operating temperature and lower operating temperatures also provide a much smaller temperature difference between the LED and the ambient environment, thus requiring greater attention to thermal management to transfer and dissipate any excess heat generated by the LED driver and emitter so that the design operating temperature for the components are not exceeded.

As temperatures rise, the efficacy of the LED is reduced, reducing the light output, and reducing the lifespan of the LED. LED light fixtures generally include both LED drivers and LED emitters. Limiting the operating temperature is most critical for the LED emitter. The LED emitters used in light fixtures are often in the form of an LED package, for example, a package that includes one or more LEDs, a mounting substrate, for example formed from ceramic, and optionally a lens structure.

To facilitate dissipation of heat, convection, conduction, and radiation are available modes of heat transfer. For LED light fixtures, dissipation of heat by conduction is often provided by one or more LED packages being mounted on a heatsink The heatsink is generally integral with or thermally coupled with the light housing, which often includes external cooling fins to further facilitate the dissipation of heat by convection and radiation.

In prior art LED light fixtures, the heatsinks are often integral with the light housing so that the heat is efficiently conducted to the outside of the housing where it is then dissipated by convention and radiation; however, in such designs, it can be difficult to thermally isolate the LED driver from the LED emitters. Additionally, such an arrangement also limits the ability to provide a variety of orientations and quantities of LED emitters for a single light housing design, since each LED packages generally coupled directly to the one or more heatsinks when are fixed by the integral design with the housing.

In some prior art LED light fixtures, various mechanical features are used to provide selectable orientations and quantities of LED lights; however, these features can be a limitation in dissipating heat by conduction and/or can introduce unwelcome complexity and cost.

For example, to provide a selectable orientation for LED packages, one prior art design utilizes LED packages coupled by springs to mounting posts that extend from a heatsink, the elevation of the combination of springs on the posts determining the orientation of the LED package; however, this design requires heat pipes that couple the LED packages to the heatsinks. Another prior art design provides several LEDs mounted on a rotatable mounting brackets; however, the mounting bracket and rotation mechanism limits heat conduction to the external surfaces of the light housing were heat can be dissipated. Other prior art light fixture designs include a cylindrical heatsink The outer circumference of the cylindrical heatsink forms several flat surfaces around its circumference. Each flat surface receives one of a variety of different LED packages that can be each selected based on a desired LED intensity for the direction in which that particular LED package will be oriented.

To facilitate dissipation of heat from the LEDs in this prior art design, the inside of the cylindrical heatsink forms inwardly protruding cooling fins. This cooling structure arrangement has the disadvantage that the light housing is open to the environment in order to allow air to follow through the center of the cylindrical heatsink Additionally, the same heatsink surface and associated mass is used to receive each LED package, regardless of the amount of heat that needs to be dissipated from the particular LED package coupled to that heatsink surface and associated mass.

Therefore, it is desirable to provide a light fixture design having a single housings that can provide multiple LED configurations and appropriate heatsinks and reflectors designed for each LED configuration.

SUMMARY

The present invention may comprise one or more of the features recited in the attached claims, and/or one or more of the following features and combinations thereof.

An illustrative lighting fixture provides a light housing, a thermally conductive annular surface, one of a selection of light reflectors, and an associated lens cover, mounting pads defined by the annual surface and the light reflector together receiving a selected number of light emitters and associated heatsinks coupled to selected mounting pads. Each of the selection of light reflectors includes openings and reflective surfaces matching a number and combination of positions of light emitters.

An illustrative embodiment of a light fixture for light emitters includes a light housing defining a mounting position, a thermally conductive annular surface defining a plurality of mounting pads and thermally coupled to the light housing, the plurality of mounting pads inwardly facing one another, a plurality of light emitters coupled to selective ones of the plurality of mounting pads, and a plurality of heatsinks, each of the plurality of heatsinks thermally coupling each of the plurality of light emitters and annular surface.

The illustrative light fixture can include a selected one of a plurality of light reflectors coupled to the light housing, each of the plurality of light reflectors interchangeably couplable with the light housing and defining reflective surfaces and openings matched with a different combination of the plurality of light emitters coupled to selective ones of the plurality of mounting pads, and the reflective surfaces and openings of each of the plurality of reflectors provides a lighting pattern different from that provided by the reflective surfaces and openings of a different one of the plurality of light reflectors. The illustrative light fixture can further include a lens cover coupled with the housing, the housing and lens cover enclosing the annular surface, one of the plurality of light reflectors, the plurality of light emitters, and the plurality of heatsinks.

Each of the plurality of heatsinks can define a convex polyhedron. The plurality of light emitters each include an LED emitter mounted on a planar substrate, the substrate material selected to thermally conduct heat from the LED emitter to an opposite side of the substrate.

The illustrative light fixture can further include a plurality of cooling fins defined by a portion of the light housing and thermally coupled to the annular surface. The annular surface and plurality of cooling fins can be each integral with and defined by a portion of the light housing. A cone reflector can be coupled with the selected one of a plurality of light reflectors, and wherein the cone reflector directions light about axially from the annual surface.

Additional features of the disclosure will become apparent to those skilled in the art upon consideration of the following detailed description of the illustrative embodiment.

BRIEF DESCRIPTION OF THE DRAWINGS

The detailed description particularly refers to the accompanying figures in which.

DESCRIPTION OF THE ILLUSTRATIVE EMBODIMENTS

Figure 1:
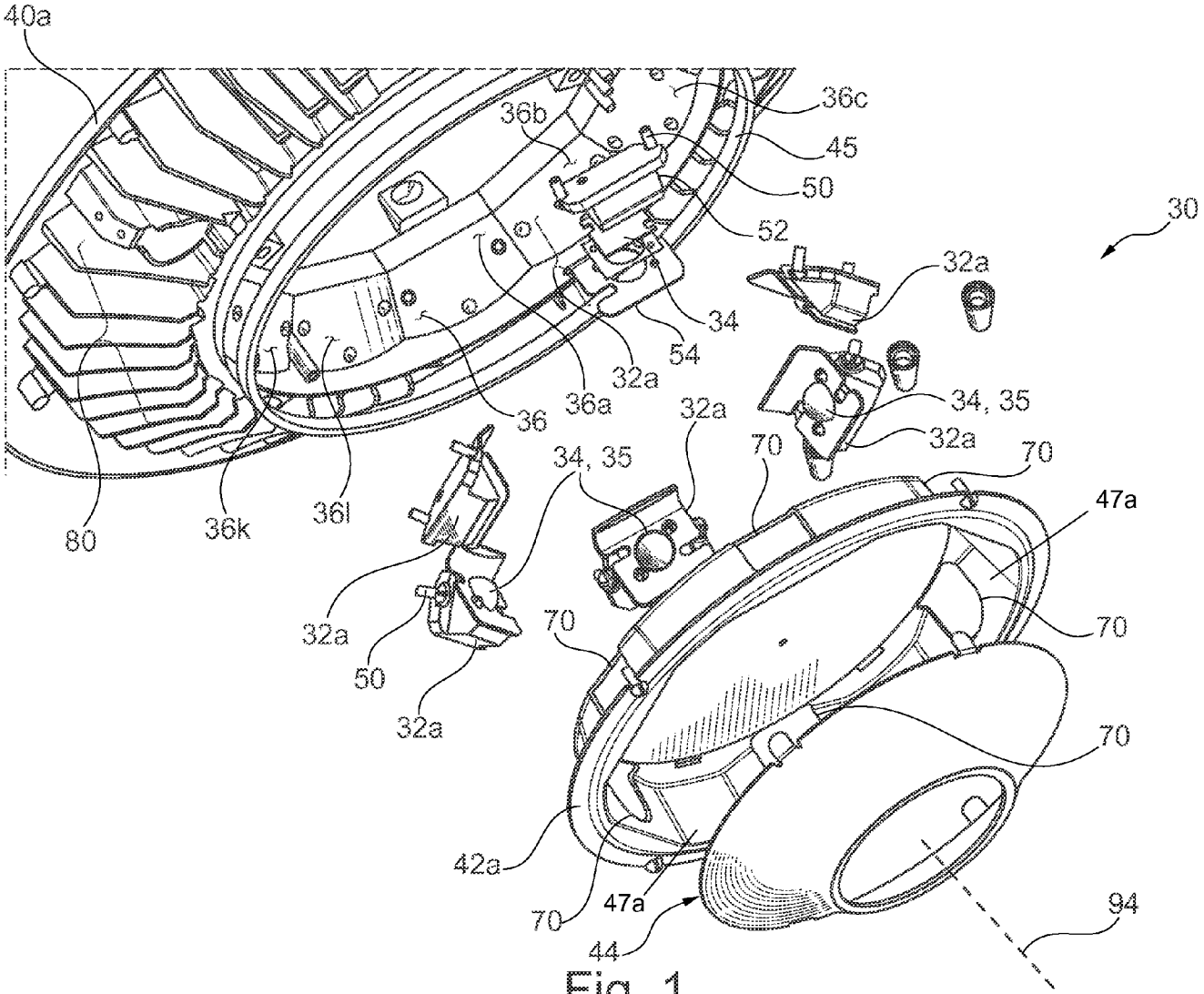
FIG. 1 is a exploded perspective view of a an illustrative light fixture having a first illustrative selection of light emitter positions and quantity and matching reflector according to the present invention.

For the purposes of promoting and understanding the principals of the invention, reference will now be made to one or more illustrative embodiments illustrated in the drawings and specific language will be used to describe the same.

Figure 2:
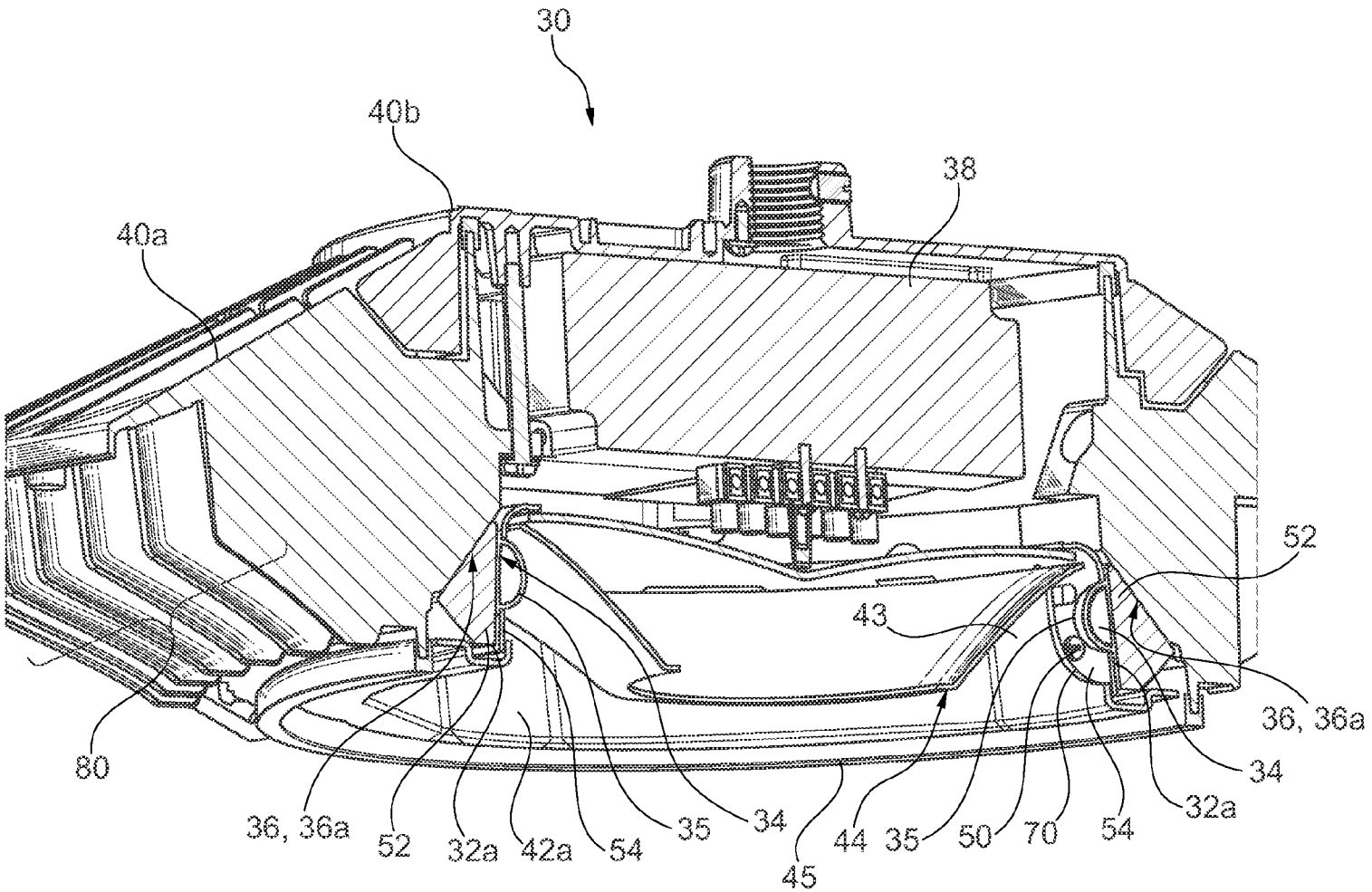
FIG. 2 is a sectional view of the light fixture of FIG. 1, taken along the section line 2-2 shown in FIG. 3.
Figure 3:
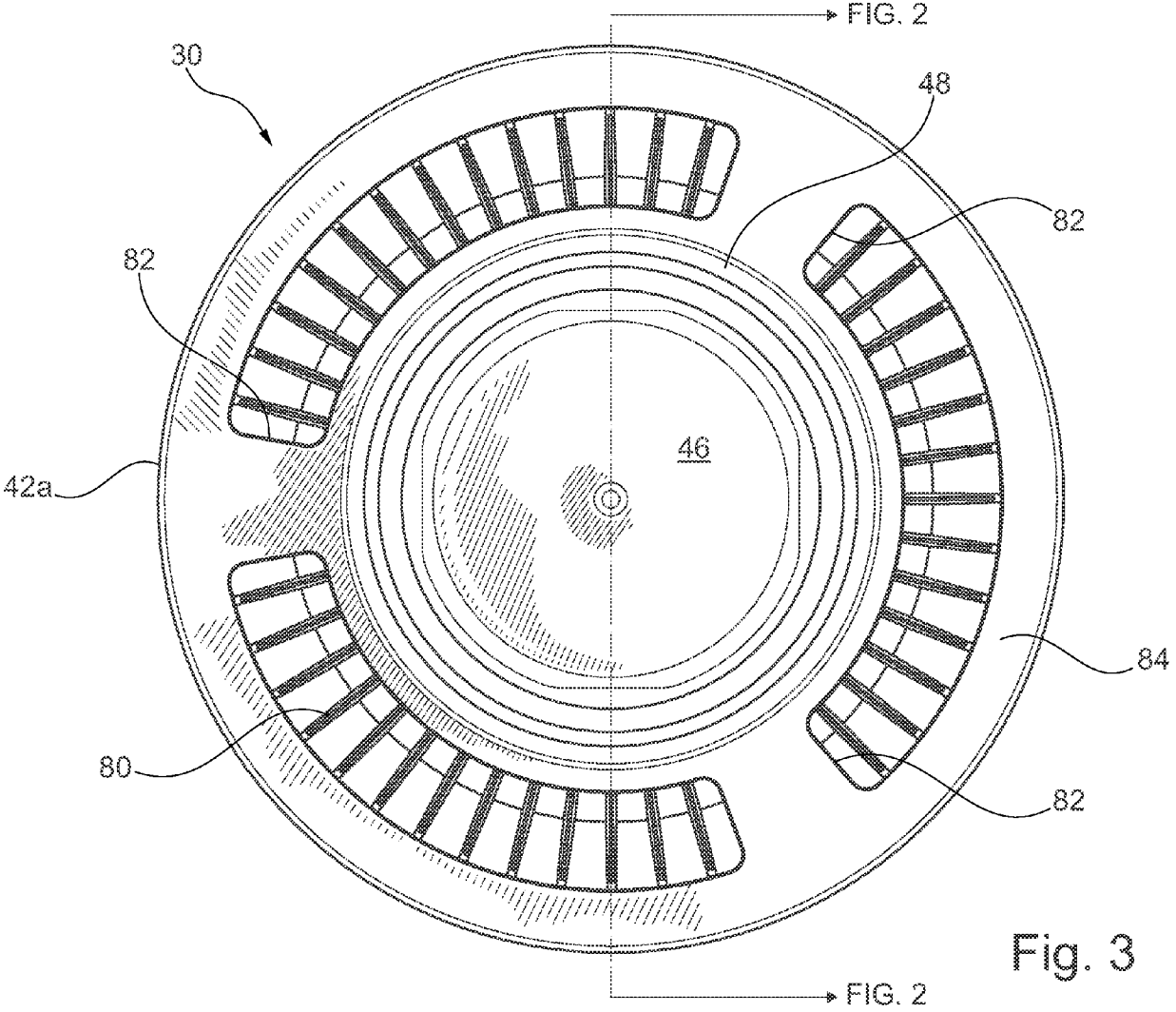
FIG. 3 is a assembled bottom view of the light fixture of FIG. 1.

Referring to FIGS. 1-3, a first illustrative embodiment of a light fixture 30 according to the present invention is illustrated. Referring to FIG. 1, the light fixture 30 includes a first selection of light emitter packages 32*a*, an annular heat transfer surface 36 having emitter package mounting pads 36*a*-36*l*, an emitter driver 38 (FIG. 2; as used herein, "driver" refers to a single driver or an array of drivers), a light housing 40*a* and 40*b* (FIG. 2), light reflector 42*a*, optional light reflector 44, seal 45, lens 46 (FIG. 3), and lens frame 48 (FIG. 3), and fasteners 50 for securing light emitter packages 32*a* to the annular heat transfer surface 36. As shown in FIG. 1, the mounting pads 36*a*-36*l* may be contiguous. A rear light housing 40*b* houses the driver 38. A front housing 40*b* includes the annular heat transfer surface 36 and houses the light emitter packages 32*a* and the lens frame 48.

Each light emitter package 32*a* includes an emitter 34 (as used herein, "emitter" refers to a single emitter or an array of emitters). The emitter 34 may be, but is not limited to, an LED emitter as are typically used in the commercial lighting industry in combination with a driver 38. Such LEDs as are commonly available in a planar array package such as that illustrated for emitter 34 in FIGS. 1 and 2. In the illustrative embodiment, each emitter 34 is further coupled with a heatsink 52, reflector 54, and optic 35 to form a light emitter package 32*a*.

The light housing 40*a* and 40*b*, annular surface 36, and heatsinks 52 can be, for example, die cast from aluminum or an aluminum alloy. Other thermally conductive materials known in the art can also be used, and portions of light housing 40*a* and 40*b* may also have thermally isolating properties to ensure dissipation of heat away from the light emitter packages 32*a* and to limit or prevent prevent heat from other components, for example the driver 38, from being transmitted toward the light emitter packages. The light reflectors 42*a*, 44, and 54 can be, for example, formed by stamping aluminum or an aluminum alloy, or a moldable material capable of withstanding the heat within the light fixture 30.

Figure 4:
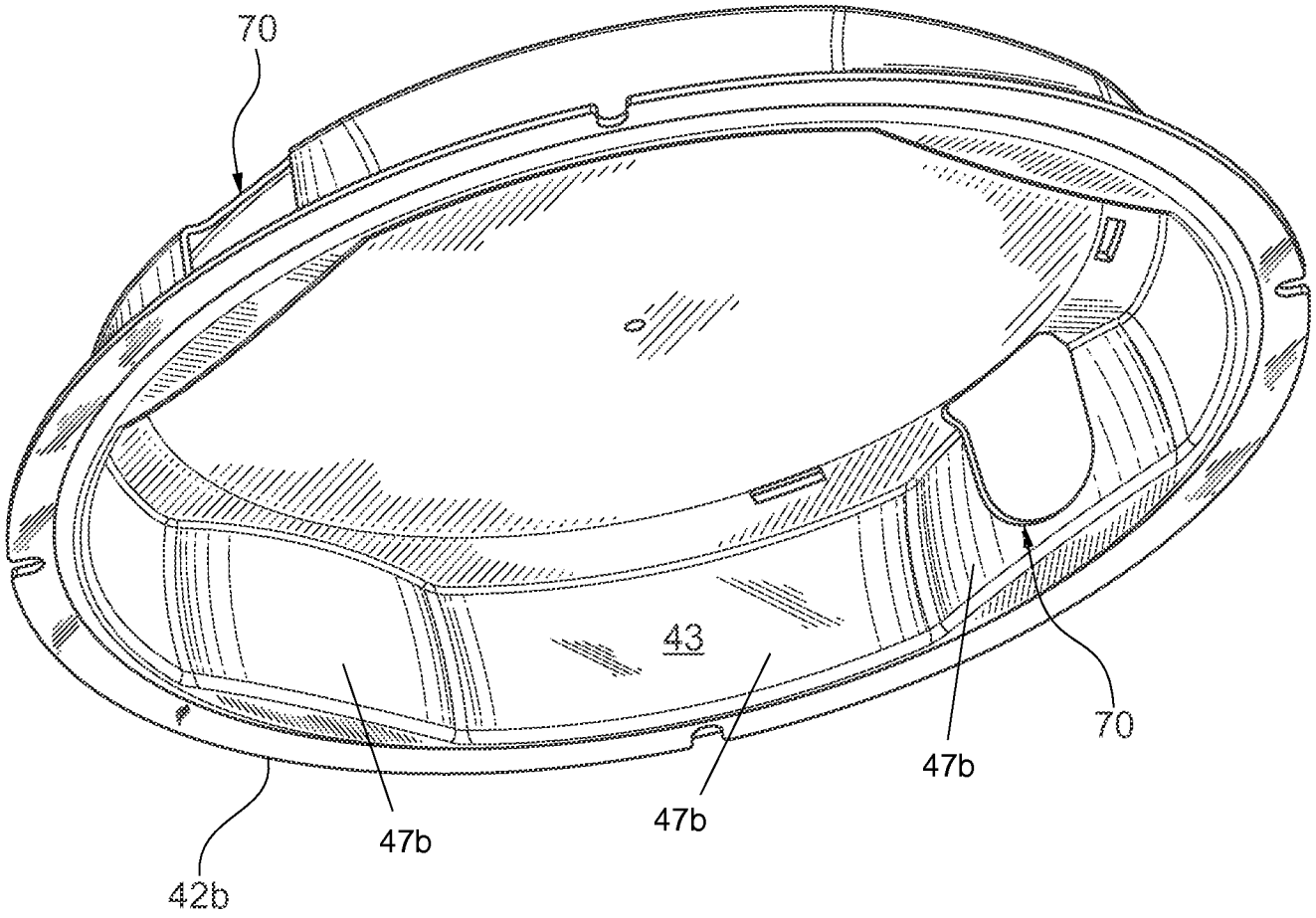
FIG. 4 is a perspective view of a second illustrative reflector for a second illustrative selection of light emitter positions and quantity according to the present invention.

Referring to FIGS. 1 and 4, the illustrative lighting system provides a variety of light fixture 30 configurations, each providing a different lighting distribution, including intensity and pattern, while using a single common light housing 40*a* and 40*b* and single common associated components. For example, common components used with the light housings 40*a* and 40*b* include the light emitter packages 32*a*, annular surface 36, driver 38, seal 45, lens 46, and frame 48. The light housing 40*a* and 40*b* and associated components can interchangeably receive any one of the illustrative light reflectors 42*a* (FIG. 1) and 42*b* (FIG. 4) or other reflectors (not shown), which each have a different selection of emitter openings 70 in number and location based on the selection of mounting pads 36*a*-36*l* populated with coupled emitter packages 32*a*. That is, there are different selectable arrangements of light emitter packages 32*a*, and the different reflectors (such as 42*a* and 42*b*) define reflective surfaces and openings matched with a different one of the selectable arrangements. The openings, as shown in FIG. 2, allow emitters 34 to transmit light into the area of reflector 42*a*, and allow optics 35 to protrude from an exterior side to an interior side 43 of the reflector 42*a*. A portion or all of the light emitter packages 32*a* optionally extend through the openings 70.

For example, in FIG. 1, a first selection, or selected arrangement, of emitter packages 32*a* include six emitters 34 and heatsinks 52 and associated components (together forming emitter packages 32*a*) for coupling with mounting pads 36*a*, 36*c*, 36*e*, 36*g*, 36*i*, 36*k*, basically populating ever other one, or less than all, of mounting pads 36*a*-36*l* around annular surface 36. In contrast, the light reflector 42*b* shown in FIG. 4 includes two openings 70, for example, so that a second selection of emitter packages 32*a* includes two emitters 34 and heatsinks 54 and associated components coupled to mounting pads 36*a* and 36*g*, in this example positioned on opposite sides of the annular surface 36. Any other combination of sections of numbers and locations of emitters packages associated with annular surface 36 can be provided with an associated reflector having an appropriate number and locations of openings 70.

Thus, in the illustrative lighting system, a single housing 40*a* and 40*b*, annual surface 36, emitters 34, optics 35, heatsinks 52, reflectors 54, lens 46, frame 48, and other associated components are all common parts used in all of light fixtures 30, while a selected one of interchangeable light reflectors 42*a* and 42*b* and number and location of emitter packages 32*a* are selected for each light fixture and coupled to annual surface 36 to provide a desired lighting distribution for that fixture. Lighting distributions can include, but are not limited to, the intensity and/or pattern of light provided by the light fixtures. For example, in some light fixtures 30, the light distribution is desired to be only to one side, such as a wall area being lighted by a light fixture mounted on a ceiling adjacent the wall. Alternatively a light fixture 30 may be mounted on a ceiling and a light pattern be desired to light the floor under the fixture. Such a downlight application can be facilitated by a selected number of lights evenly distributed around the periphery of the annular surface and the inclusion of optional reflector 44 that helps to direct the light downward, parallel to a central axis 94 (FIG. 1).

Selective population of each of the planar the mounting pads 36*a*-36*l*, in combination with the design of reflectors 42*a*, 42*b*, 44 and other possible reflector designs provide for many different lighting patterns from the same light fixture 30 design. For example, the locations of mounting pads 36*a*-36*l* that are populated can provide light extending in only one axial direction from the light fixture 30, more than one axial direction around the circumference of the fixture 30, throughout the circumference of the fixture 30, and/or brighter and dimmer sections around the circumference of the fixture 30. Additionally, in one embodiment, the lumens and/or distribution provided by an emitter 34 and lens 35 can vary between the emitter packages 32*a* populating selected ones of the mounting pads 32*a*-36*l*, thereby providing further variations in available light distribution provided by the single light fixture 30 design.

The annular surface 36 forms a ring that is sloped such that the top diameter is less than the bottom diameter and so that mounting pads 36*a*-36*l* are inwardly obliquely faced, forming a circular radiation pattern that allows for a more flexible light distribution than if faced outwardly since the reflectors 42*a*, 42*b*, and 44 allow for redirection of the emitted light.

In some embodiments, the mount pads 36*a*-36*l* formed on annular surface 36 can be integrally formed with the housing 40*a* and 40*b*. For example, referring to FIG. 2, the annular surface 36 is integrally formed in a lower, or main housing 40*a*, which also integrally defines fins 80, spokes 82 (FIG. 3), and rim 84 formed around the periphery of the housing 40*a*. Alternatively, spokes 82 and rim 84 can be a separate bottom cover portion of the fixture 30. Regardless, the advantage of the emitters 34 being thermally coupled through heatsinks 52 and annular surface 36 integral with cooling fins 80 transfers heat efficiently from the emitters 34 to the environment around the fixture 30, especially the air flowing through the fins 80.

In some embodiments, the heatsinks 52 are each defined as in shape of a convex polyhedron, for example, a generally wedge shape, and are coupled with the annular surface 36, for example, with adhesive or other fasteners 50 known in the art. In some embodiments, the heatsinks 52 are integrally formed with the planar surface 36 in the positions and number desired for the selection of emitter packages 32*a*. While the heatsinks 52 increase the available thermal mass for heat dissipation from the associated emitter 34, the generally wedge shape of the heatsinks advantageously change the direction of illumination of the light emitters 34 from that provided by the mounting pads 36*a*-36*l* such that the direction of illumination is inward, perpendicular to central axis 94 until acted upon by the surfaces of the reflectors 42*a* and 44.

The combination of the orientation of the mounting pads 36*a*-36*l* of annular surface 36 and the shape defined by the heatsinks 42 and the resulting relative orientations, including positions of emitters 34 provide a desired alignment feature that contributes to the desired light distribution. For example, as shown in FIGS. 1 and 2, the mounting pads 36*a*-36*l* forming annular surface 36 face angularly inward toward one another on opposite sides of the annular surface 36. Thus, if it is desired that light only be project in one direction axially out from axis 34, the selection of emitter packages 32*a* is to locate one or a few packages grouped next to one another to emit light in the desired direction. Additionally the particular selected reflector 42*a* or 42*b* and optional reflector 44 can further direct light with reflective surfaces 47*a* (FIG. 1) and 47*b* (FIG. 4) located and oriented to direct the light in the desired distribution pattern.

While the invention has been illustrated and described in detail in the foregoing drawings and description, the same is to be considered as illustrative and not restrictive in character, it being understood that only illustrative embodiments thereof have been shown and described and that all equivalents and all changes and modifications known in the art that come within the spirit and scope of the invention as defined herein are desired to be protected.

The invention claimed is:

1. A light fixture for light emitters, comprising:

a light housing;

a thermally conductive annular surface defining a plurality of contiguous mounting pads and thermally coupled to the light housing, the plurality of contiguous mounting pads inwardly facing one another; and a plurality of light emitter packages coupled to selective ones of the plurality of contiguous mounting pads according to a selected arrangement, each of the plurality of light emitter packages including a light emitter and a heatsink, the heatsink thermally coupling the light emitter and one of the plurality of contiguous mounting pads.

2. The light fixture of claim 1, further comprising:

a plurality of light reflectors interchangeably couplable to the light housing, each of the plurality of light reflectors defining reflective surfaces and openings matched with a different one of different selectable arrangements of light emitter packages; and a selected one of the plurality of light reflectors coupled to the light housing and defining reflective surfaces and openings matched with the selected arrangement of light emitter packages.

3. The light fixture of claim 2, wherein the reflective surfaces and openings of one of the plurality of reflectors provides a lighting pattern different from that provided by the reflective surfaces and openings of a different one of the plurality of light reflectors.

4. The light fixture of claim 1, wherein mounting pads located on opposite sides of the annular surface are oblique.

5. The light fixture of claim 1, wherein each of the heatsinks define a generally wedge shaped convex polyhedron.

6. The light fixture of claim 1, wherein a light emitter mounting surface of each of the heatsink is about parallel to a central axis of the annular surface.

7. The light fixture of claim 2, further comprising a lens coupled with the housing, the housing and lens enclosing the annular surface, the selected one of the plurality of light reflectors, and the plurality of light emitter packages.

8. The light fixture of claim 1, further comprising a plurality of cooling fins, and wherein the plurality of cooling fins are defined by a portion of the light housing and the plurality of cooling fins are thermally coupled to the annular surface.

9. The light fixture of claim 8, wherein the annular surface and plurality of cooling fins are each integral with and defined by a portion of the light housing.

10. The light fixture of claim 2, further comprising a cone reflector coupled with the selected one of the plurality of light reflectors positioned centrally within the annual surface.

11. The light fixture of claim 10, wherein the cone reflector directs light about axially from the annual surface.

12. A light fixture for light emitters, comprising:

a light housing defining a mounting position;

a thermally conductive annular surface defining a plurality of mounting pads and thermally coupled to the light housing;

a plurality of light emitter packages interchangeably couplable to the mounting pads according to different selectable arrangements, each of the plurality of light emitter packages including a heatsink and a light emitter, the heatsink for thermally coupling the light emitter and one of the plurality of mounting pads; and a plurality of light reflectors interchangeably couplable to the light housing, each of the plurality of light reflectors defining reflective surfaces and openings matched with a different one of the different selectable arrangements;

wherein each of the light reflectors has a different number or location of emitter openings.

13. The light fixture of claim 12, wherein the plurality of mounting pads inwardly face one another.

14. The light fixture of claim 12, wherein the reflective surfaces and openings of one of the plurality of reflectors provides a lighting pattern different from that provided by the reflective surfaces and openings of a different one of the plurality of light reflectors.

15. The light fixture of claim 12, wherein ones of the plurality of mounting pads located on opposite sides of the annular surface are oblique.

16. The light fixture of claim 12, wherein a light emitter mounting surface of each of the heatsinks is about parallel to a central axis of the annular surface.

17. The light fixture of claim 12, further comprising a plurality of cooling fins, and wherein the plurality of cooling fins are defined by a portion of the light housing and the plurality of cooling fins are thermally coupled to the annular surface.

18. The light fixture of claim 17, wherein the annular surface and plurality of cooling fins are each integral with and defined by a portion of the light housing.

* * * * *